US006287026B1

(12) United States Patent
Twist

(10) Patent No.: US 6,287,026 B1
(45) Date of Patent: Sep. 11, 2001

(54) METHOD OF REPLENISHMENT FOR PROCESSING

(75) Inventor: Peter J. Twist, Gt. Missenden (GB)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/593,985

(22) Filed: Jun. 14, 2000

Related U.S. Application Data

(62) Division of application No. 09/461,145, filed on Dec. 14, 1999.

(30) Foreign Application Priority Data

Dec. 19, 1998 (GB) ..... 98 27 971
Aug. 4, 1999 (GB) ..... 99 18 232

(51) Int. Cl.[7] ..... G03D 3/02
(52) U.S. Cl. ..... 396/626; 396/627; 396/636
(58) Field of Search ..... 396/604, 606, 396/609, 626, 627, 636; 355/27–29; 134/64 P, 64 R, 122 P, 122 R

(56) References Cited

U.S. PATENT DOCUMENTS 3,418,912 12/1968 Land et al. ..... 396/605
3,872,827 3/1975 Howe et al. ..... 396/606
3,912,833 * 10/1975 Becker ..... 396/609
4,533,225 * 8/1985 Shiga ..... 396/626
4,929,974 * 5/1990 Sakamoto et al. ..... 396/626
4,963,473 * 10/1990 Nakano et al. ..... 396/617
5,075,711 * 12/1991 Ohba ..... 396/620
5,266,994 * 11/1993 Desai et al. ..... 396/617
5,357,305 * 10/1994 Long ..... 396/604
5,380,627 1/1995 Grimsey ..... 430/399
5,387,499 * 2/1995 Earle et al. ..... 396/626
5,394,215 2/1995 Glover ..... 396/614
5,649,261 * 7/1997 Schlickhoff et al. ..... 396/626
5,659,835 * 8/1997 Earle et al. ..... 396/626
5,758,223 5/1998 Kobojski et al. ..... 396/604
6,012,859 * 1/2000 Boller et al. ..... 396/620

FOREIGN PATENT DOCUMENTS 3942395 6/1991 (DE) .

* cited by examiner

*Primary Examiner*—D. Rutledge
(74) *Attorney, Agent, or Firm*—Frank Pincelli

(57) ABSTRACT

A method of replenishing a processing solution by adding the replenisher directly to the surface of the emulsion side of the material to be processed. This accelerates the processing of the material and maintains the sensitometry of the processing solution.

6 Claims, 3 Drawing Sheets

METHOD OF REPLENISHMENT FOR PROCESSING

CROSS REFERENCE TO RELATED APPLICATIONS

This is a divisional of application Ser. No. 09/461,145, filed Dec. 14, 1999.

FIELD OF THE INVENTION

The invention relates to the replenishment of processes and is more particularly, although not exclusively, concerned with the replenishment of photographic processes.

BACKGROUND OF THE INVENTION

It is well known that photographic processing solutions need to be replenished periodically in photographic processing apparatus to maintain constant sensitometry for the material being processed. Replenishment is made to the processing solutions so that their chemical composition and activity are kept within specified limits to maintain sensitometry for the material being processed.

The normal method of replenishment of photographic processing solutions in a continuous processor is to add liquids or solids to a processing tank and mix the replenisher into the tank solution by means of pumped recirculation. Replenishers must be at a higher concentration than the tank solution in order to make up for chemical usage by sensitized material which can be either paper or film.

In order to minimize both costs and waste there is a need to shorten process time and also to make more efficient use of the processing chemistry.

SUMMARY OF THE INVENTION

It is an aim of the invention to provide a method of replenishment which will increase the processing speed but will use no more replenisher than methods known in the prior art.

The invention resides in a method of applying replenisher to the emulsion surface of the paper in order to accelerate development. The replenisher can be applied just after the paper has entered the developer or before. Replenisher is applied at a rate equal to or less than the replenishment rate for the paper; which depending on the process is between 30 and 150 ml/sq.m. This solution, which can be a "made-up single solution" or multiple concentrates and water, would under normal circumstances be metered into the developer solution. The replenisher that is applied to the paper ultimately ends-up in the developer solution and the final seasoned position is the same as it would normally be. Since the replenisher is more concentrated than the developer it develops faster and an overall reduction in development time is possible including the replenisher application stage as part of the total time.

The invention is equally applicable to the processing of film, either black or white or color.

In accordance with the present invention there is provided a method of replenishing a processing solution used to process a material having an emulsion surface and a non-emulsion surface, the method characterized by the step of adding the replenisher directly to the surface of the material by means of an applicator positioned on the emulsion side of the material, so as to accelerate processing of the material and maintain sensitometry of said process solution. Preferably the replenisher is applied by means of a foam pad. In one example of the invention the replenisher is applied while the material is in the processing solution. However, the replenisher may be applied immediately before the material enters the processing solution.

The present invention further provides a processing apparatus for processing a material having an emulsion surface and a non-emulsion surface, the apparatus comprising at least one processing stage having a processing solution which is used to process the material, characterized in that the apparatus further includes replenishment means positioned to supply replenisher directly to the emulsion side of the material so as to accelerate processing of the material and maintain sensitometry of the process solution.

The present invention combines the advantages of surface application and tank processing while removing the disadvantages of surface application.

When surface application is used as the only method of processing the initial rate of processing can be high but this rate slows rapidly due to the accumulation of seasoning products in the emulsion layers. This is because the volume applied to the surface is limited compared to a conventional deep tank. Normal replenishment replaces the chemistry used to form the image and is based on average customer density. This average is about 25% of the maximum density, Dmax, over the whole paper area. In a given image it is not known where the regions of maximum density, Dmax, and minimum density, Dmin, are until after processing. This does not matter in a conventional deep tank process since there is a large volume sufficient to process any density of image. If however the complete process is run using only surface application a higher amount of processing chemistry must be spread over the paper so that 100% Dmax can be reached everywhere in the image. The excess chemistry left after surface application cannot be re-cycled. Thus the usage rate is about four times that of a conventional deep tank.

The disadvantages are overcome by the present invention since only part of the process involves surface application and the rest is completed in a conventional tank. The high initial rate of processing with surface application is maintained but the rapid fall-off is avoided due to the paper passing through into a conventional processing tank where seasoning products are dispersed to a normal concentration. Only the normal amount of replenisher is spread over the surface of the paper and any that is unused passes into the tank. Thus the chemical usage is identical to that of a conventionally replenished process. When the present invention is used for replenishing a photographic process the processing time is shortened. The overall chemical usage rates and tank concentrations are unchanged from the usage rates and concentrations of conventional processing systems.

BRIEF DESCRIPTION OF THE DRAWINGS

For a better understanding of the invention, reference will now be made, by way of example only, to the accompanying drawings in which.

DETAILED DESCRIPTION OF THE INVENTION

Figure 1:
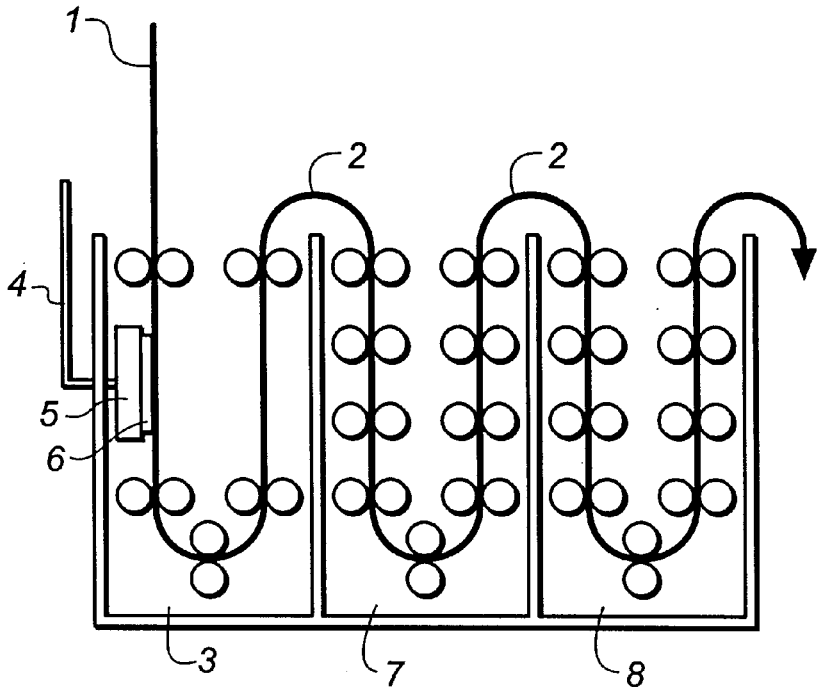
FIG. 1 is a schematic side elevational view of part of a photographic processing apparatus embodying the present invention.

FIG. 1 shows an apparatus in which the present invention can be utilized. In this example material 1 to be processed passes through a developer tank 3, a bleach-fix tank 7 and a stabilizer tank 8. The material 1 is transported through the tanks by means of rollers. A crossover 2 is located between the developer tank 3 and the bleach-fix tank 7 and between the bleach-fix tank 7 and the stabilizer tank 8.

An applicator 6 is positioned within the developer tank 3. The applicator is positioned such that it will be in direct contact with the front surface of the material transported through the processing system. In this particular embodiment the applicator 6 is a foam pad provided with a casing 5. The casing encloses the applicator 6 on all sides other than that side which directly contacts the material 1. A supply pipe 4 is connected to the applicator 6 for the supply of replenisher.

In operation replenisher is pumped through the supply pipe 4 to the applicator 6. The replenisher passes through the foam pad from the back to the front. This replenisher is at a higher concentration and pH than the developer solution in the tank 3. As the material 1 is in direct contact with the applicator 6 it processes more rapidly than if it merely passes through the solution in the tank. This is because as soon as the replenisher contacts the emulsion surface of the material 1 the processing accelerates and continues at a high rate for some time after the material passes the applicator 6. The rate eventually falls to the conventional tank rate.

The overall concentration and pH of the developer solution in the tank remains the same as in conventional methods of replenishment since the amount of replenisher added is identical. After the application of replenisher to the surface of the material 1 the concentration in the photographic layers will be higher than otherwise and will fall over a period of time to that of the solution in the tank.

A second application of replenisher could be made consistent with the overall replenishment rate in order to further accelerate the process. It is possible to make several applications provided the amount of replenisher added is consistent with the usage rate of the material.

Figure 2:
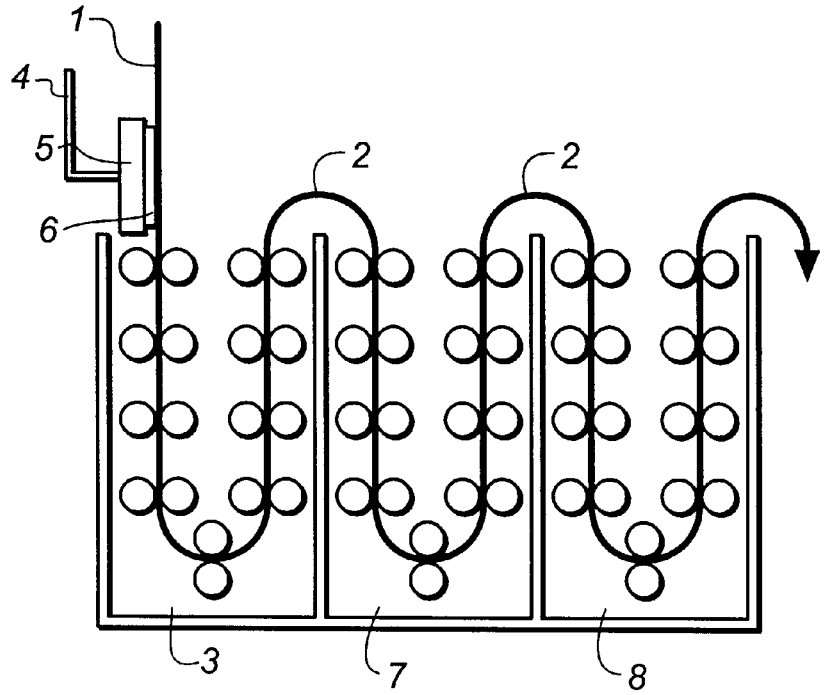
FIG. 2 is a schematic view of a second embodiment of the invention.

FIG. 2 shows a second embodiment of the invention. The developer tank 3, bleach-fix tank 7 and stabilizer tank 8 are as described with reference to FIG. 1. However, in this embodiment the applicator 6 is positioned to apply replenisher to the surface of the material prior to the material entering the developer tank 3.

Figure 3:
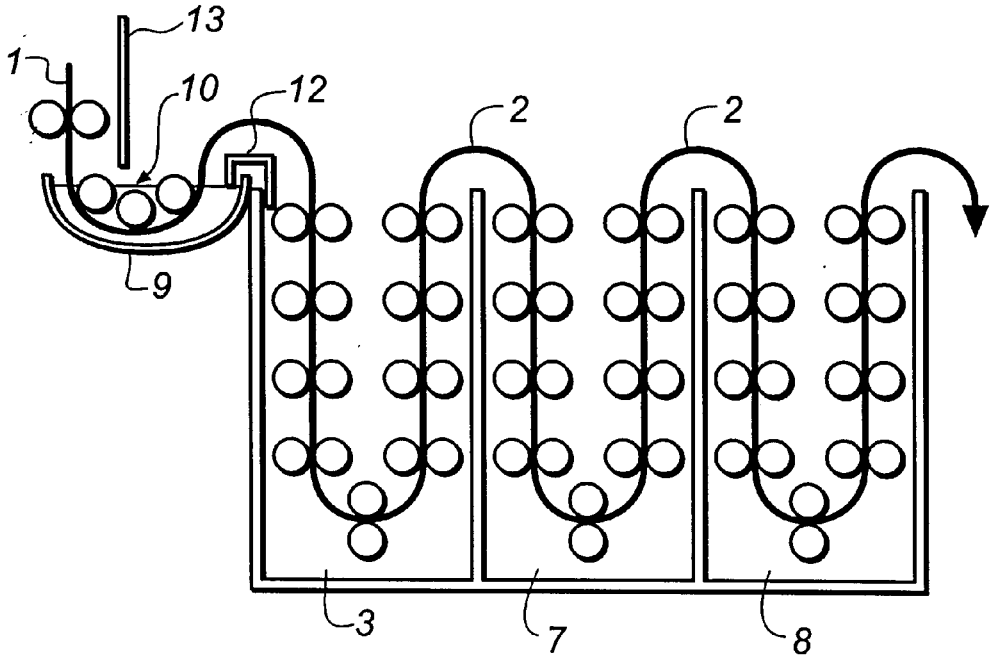
FIG. 3 is a schematic view of a third embodiment of the invention.

FIG. 3 shows a third embodiment of the invention. Material 1 to be processed passes through a developer tank 3, a bleach-fix tank 7 and a stabilizer tank 8 as described with respect to FIG. 1. However, in this embodiment a tray 9 is positioned prior to the developer tank 3. Guide rollers 10 are provided to guide the material 1 through the tray 9. A replenisher siphon pipe 12 and a replenisher supply pipe 13 are also provided for the application of the replenisher to the material.

Figure 4:
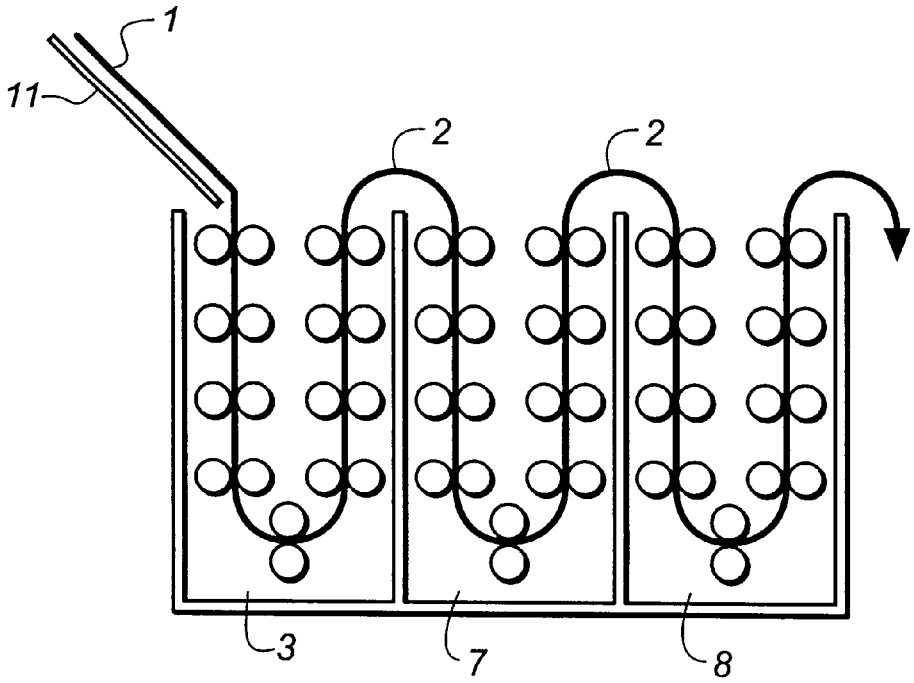
FIG. 4 is a schematic view of a fourth embodiment of the invention.

FIG. 4 shows a fourth embodiment of the invention. In this embodiment the material 1 passes down an inclined plane prior to entering the developer tank 3. An applicator is positioned at the top of the inclined plane. The replenisher is added to the surface of the material at the top of the inclined plane via the applicator. This may be by means of slots or a series of holes in the plane or by any other suitable means.

Figure 5:
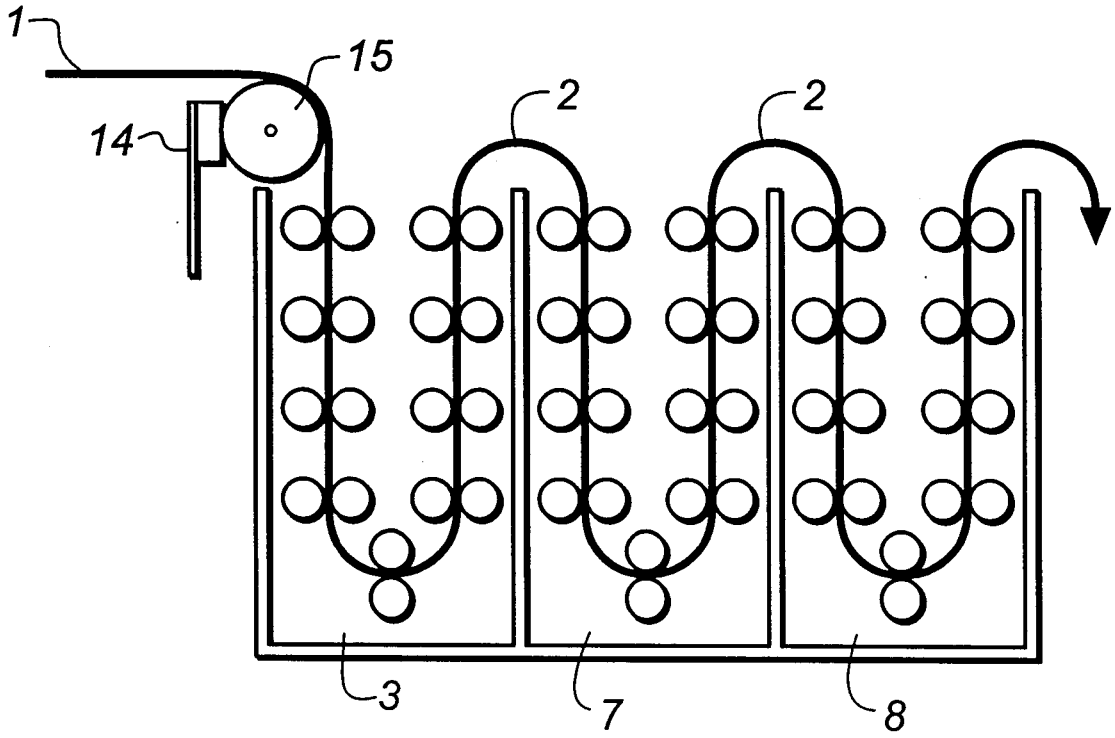
FIG. 5 is a schematic view of a fifth embodiment of the invention.

FIG. 5 shows a fifth embodiment of the invention. The developer tank 3, bleach-fix tank 7 and stabilizer tank 8 are as described with reference to FIG. 1. In this embodiment the replenisher is applied to the surface of the material 1 by means of a rotating drum 15 having a textured surface. The drum is positioned prior to entry to the developer tank 3. Replenisher is applied to the rotating drum 15 via applicator 14. The material 1 moves emulsion side down over the drum surface wetted by the replenisher and processing starts. The material 1 then passes into tank 3. Excess replenisher is either carried into the tank 3 by the material or falls off the drum 15 into the tank 3.

In a further embodiment, not illustrated, the replenisher is applied to the surface of the material during the cross-over from one tank to the next tank.

It is possible to heat the replenisher to a higher temperature than the tank solution, e.g. 70°, to further accelerate the process. As the replenisher will only be at this elevated temperature for a short time stability and evaporation are not a concern.

The material being processed may be paper or film, either color or black or white. The method may be applied to developer, amplifier, intensifier, bleach-fix, bleach, fix or any other stage in a photographic process.

Specific examples of the method of the invention will now be described.

EXAMPLE 1

Preliminary tests were carried out by immersing paper by hand for a short time in replenisher to simulate surface application, followed by development in a measuring cylinder with hand agitation. The replenisher and developer compositions used are shown in Table 1.

TABLE 1

Replenisher and developer composition

| Component | Developer | Replenisher (1) | Replenisher (2) |
|---|---|---|---|
| Triethnolamine | 5.5 ml/l | 5.5 ml/l | 5.5 ml/l |
| Versa TL-73 | 0.25 ml/l | 0.25 ml/l | 0.25 ml/l |
| $K_2SO_3$ | 0.32 g/l | 0.32 g/l | 0.32 g/l |
| DEH | 5.0 ml/l | 8.0 ml/l | 8.0 ml/l |
| REU | 1.0 g/l | 1.5 g/l | 1.5 g/l |
| $Li_2SO_4$ | 2.0 g/l | 2.0 g/l | 2.0 g/l |
| AC5 | 0.6 ml/l | 0.6 ml/l | 0.6 ml/l |
| KCl | 6.4 g/l | 4.5 g/l | 2.6 g/l |
| KBr | 0.028 g/l | 0.025 g/l | 0.014 g/l |
| CD3 | 4.35 g/l | 6.8 g/l | 9.25 g/l |
| $K_2CO_3$ | 25.0 g/l | 25.0 g/l | 25.0 g/l |
| pH | 10.1 | 10.75 | 11.0 |
| rep. rate | — | 150 ml/sq. m | 75 ml/sq. m |

where Versa TL-73® is a surfactant. DEH is an 85% solution of diethyl hydroxylamine. REU is an optical brightener Phorwite REU®. AC5 is 1-hydroxyethylidene-1,1-diphosphonic acid. CD3 is N-[2-(4-amino-N-ethyl-m-toluidino)ethyl]-methanesulphonamide sesquisulphate hydrate.

The process cycle used is shown in Table 2.

TABLE 2

Process Cycle

| | |
|---|---|
| Replenisher Application | 0, 5, 10 or 15 seconds |
| Development | see table 3 |

TABLE 2-continued

| Process Cycle | |
|---|---|
| Bleach-fix | 45 seconds |
| Wash | 2 minutes |

where bleach-fix is Kodak RA-Prime bleach-fix.

The data shown in Table 3 illustrate the development acceleration obtained.

TABLE 3

Replenisher (1) Pretreatment

| Time (sec) | | | Dmax | | | Shoulder | | |
|---|---|---|---|---|---|---|---|---|
| Rep | Dev | Temp (° C.) | R | G | B | R | G | B |
| 0 | 15 | 37.8 | 2.39 | 1.61 | 1.07 | 1.63 | 1.33 | 1.06 |
| 0 | 30 | 37.8 | 2.52 | 2.41 | 2.13 | 1.86 | 1.77 | 1.67 |
| 0 | 45 | 37.8 | 2.48 | 2.44 | 2.33 | 1.91 | 1.92 | 1.98 |
| 5 | 25 | 37.8 | 2.54 | 2.57 | 2.36 | 1.88 | 1.88 | 1.85 |
| 10 | 20 | 37.8 | 2.51 | 2.58 | 2.36 | 1.90 | 1.90 | 1.94 |
| 15 | 15 | 37.8 | 2.53 | 2.56 | 2.35 | 1.91 | 1.89 | 1.93 |

where Rep is the time in seconds in the replenisher(1) solution, Dev is the time in seconds in the developer solution. The first three processes are for different developer times without replenisher application. The standard time for this developer is 45 seconds and at 30 seconds development the blue and green records are low of aim in the upper-scale. It can be seen that even a 5 second immersion in replenisher, which probably equates with a true surface application procedure(shown in Example 2), gives a significant boost in performance. A total time of 5 seconds replenisher plus 25 seconds developer now gives a result significantly better than 30 seconds in developer by itself and is very close to the 45 seconds check position. Longer immersion times in the replenisher give slightly better results but would not realistically simulate surface application of replenisher. Surface application of replenisher followed by development in the normal way but for a reduced time is described in the next series of examples.

EXAMPLE 2

This data was obtained by applying a known amount of replenisher(1) to the paper surface by means of a textured rotating drum. A volume(1.5 ml) of replenisher(1) equivalent to 150 ml/sq.m was added to the surface of a rotating drum to form a "stripe" of solution 35 mm wide which adhered to the drum surface and extended the whole way round the drum. A pre-exposed 35 mm wide paper strip(0.01 sq.m) was held face-down over this "stripe" of solution for either 5, 10 or 15 seconds and then placed immediately in developer solution to complete the process. This procedure of surface application of replenisher followed by development in the standard developer solution but for a reduced time was carried-out in all the following examples. The subsequent process stages are shown in Table 2 above. Some results of various replenisher and developer treatment times are shown in Table 4.

TABLE 4

Surface Application of Replenisher(1) followed by Development

| | check 45 sec | check 30 sec | invention .30 sec | invention 30 sec | invention 30 sec |
|---|---|---|---|---|---|
| strip | 1 | 10 | 26 | 24 | 27 |
| Rep. temp ° C. | — | — | 38 | 38 | 38 |
| Dev. temp ° C. | 38 | 38 | 38 | 38 | 38 |
| Rep. time sec | 0 | 0 | 5 | 10 | 15 |
| Dev. time sec | 45 | 30 | 25 | 20 | 15 |
| Total time sec | 45 | 30 | 30 | 30 | 30 |
| Rsh | 1.975 | 1.918 | 1.916 | 1.918 | 1.831 |
| Gsh | 1.878 | 1.806 | 1.832 | 1.834 | 1.755 |
| Bsh | 1.99 | 1.816 | 1.992 | 1.993 | 1.959 |
| Rmin | 0.11 | 0.108 | 0.107 | 0.109 | 0.111 |
| Gmin | 0.112 | 0.108 | 0.107 | 0.109 | 0.112 |
| Bmin | 0.103 | 0.096 | 0.094 | 0.097 | 0.099 |

Where Rsh, Gsh and Bsh mean red, green and blue shoulder density respectively. Rmin, Gmin and Bmin mean red, green and blue minimum density respectively.

It can be seen from Table 4 that 24 and 26 are more developed than 10, the 30 second check, and are quite close to the aim process represented by 1, the 45 second check. It was discovered that applying the replenisher at 38° C. by heating the drum to 38° C. only heated the paper to about 30° C. and so the temperature of the drum was raised to account for this as shown in example 3.

EXAMPLE 3

The process cycles in this example were the same as in example 2 except that replenisher(1) was applied to the paper surface at 45° C.

TABLE 5

Surface Application of Replenisher(1) followed by Development

| | check 45 sec | check 30 sec | invention 30 sec | invention 30 sec | invention 30 sec |
|---|---|---|---|---|---|
| | 1 | 10 | 17 | 18 | 19 |
| Rep. temp ° C. | — | — | 45 | 45 | 45 |
| Dev. temp ° C. | 38 | 38 | 38 | 38 | 38 |
| Rep. time sec | 0 | 0 | 5 | 10 | 15 |
| Dev. time sec | 45 | 30 | 25 | 20 | 15 |
| Total time sec | 45 | 30 | 30 | 30 | 30 |
| Rsh | 1.975 | 1.918 | 1.985 | 1.935 | 1.879 |
| Gsh | 1.878 | 1.806 | 1.779 | 1.824 | 1.824 |
| Bsh | 1.99 | 1.816 | 1.927 | 1.958 | 1.927 |
| Rmin | 0.11 | 0.108 | 0.109 | 0.109 | 0.113 |
| Gmin | 0.112 | 0.108 | 0.107 | 0.109 | 0.114 |
| Bmin | 0.103 | 0.096 | 0.095 | 0.097 | 0.105 |

In Table 5 it can be seen that there is more development in 17, 18 and 19 in most cases than in 10, the 30 second check and 17 and 18 are quite close to 1, the aim 45 second check.

In this example heating the drum to 45° C. only heated the paper to 35° C. so another example with the drum at 50° C. was carried out as in example 4.

EXAMPLE 4

In this example the replenisher(1) was applied to the surface at 50° C. but with the same process cycles as in examples 2 and 3. After 15 seconds the paper was about 38° C. which is the aim temperature for the process.

TABLE 6

Surface Application of Replenisher(1) followed by Development

| | check 45 sec | check 30 sec | invention 30 sec | invention 30 sec | invention 30 sec |
|---|---|---|---|---|---|
| strip | 1 | 10 | 21 | 22 | 23 |
| Rep. temp ° C. | — | — | 50 | 50 | 50 |
| Dev. temp ° C. | 38 | 38 | 38 | 38 | 38 |
| Rep. time sec | 0 | 0 | 5 | 10 | 15 |
| Dev. time sec | 45 | 30 | 25 | 20 | 15 |
| Total time sec | 45 | 30 | 30 | 30 | 30 |
| Rsh | 1.975 | 1.918 | 1.941 | 1.972 | 1.929 |
| Gsh | 1.878 | 1.806 | 1.81 | 1.832 | 1.811 |
| Bsh | 1.99 | 1.816 | 2.004 | 1.972 | 1.959 |
| Rmin | 0.11 | 0.108 | 0.112 | 0.112 | 0.115 |
| Gmin | 0.112 | 0.108 | 0.110 | 0.111 | 0.116 |
| Bmin | 0.103 | 0.096 | 0.097 | 0.099 | 0.106 |

It can be seen from Table 6 that 21, 22 and 23 all exceed 10, the 30 second check and 22 is very close to 1, the 45 second aim result.

EXAMPLE 5

In this example a modified replenisher(2) designed to be used at a lower replenishment rate of 75 ml/sq.m was examined.

This data was obtained by applying a known amount of replenisher(2) to the paper surface by means of a textured rotating drum at 38° C. A volume(0.75 ml) of replenisher(2) equivalent to 75 ml/sq.m was added to the surface of a rotating drum to form a "stripe" of solution 35 mm wide which adhered to the drum surface and extended the whole way round the drum. A pre-exposed 35 mm wide paper strip(0.01 sq.m) was held face-down over this "stripe" of solution for either 5, 10 or 15 seconds and then placed immediately in developer solution to complete the process. The subsequent process stages are shown in Table 2 above. Some results of various replenisher and developer treatment times are shown in Table 7.

TABLE 7

Surface Application of Replenisher(2) followed by Development

| | check 45 sec | check 30 sec | invention 30 sec | invention 30 sec | invention 30 sec |
|---|---|---|---|---|---|
| strip | 1 | 10 | 32 | 33 | 31 |
| Rep. temp ° C. | — | — | 38 | 38 | 38 |
| Dev. temp ° C. | 38 | 38 | 38 | 38 | 38 |
| Rep. time sec | 0 | 0 | 5 | 10 | 15 |
| Dev. time sec | 45 | 30 | 25 | 20 | 15 |
| Total time sec | 45 | 30 | 30 | 30 | 30 |
| Rsh | 1.975 | 1.918 | 2.035 | 2.077 | 2.042 |
| Gsh | 1.878 | 1.806 | 1.890 | 1.906 | 1.882 |
| Bsh | 1.99 | 1.816 | 1.975 | 2.019 | 1.990 |
| Rmin | 0.11 | 0.108 | 0.116 | 0.114 | 0.115 |
| Gmin | 0.112 | 0.108 | 0.120 | 0.116 | 0.118 |
| Bmin | 0.103 | 0.096 | 0.111 | 0.108 | 0.109 |

It can be seen from Table 7 that 31, 32 and 33 are all more active than 10, the 30 second check and also more active than 1, the 45 second check. This is surprising since although the replenisher(2) is more concentrated than replenisher(1) in some components such as CD3 and has lower halide levels, the amount of replenisher(2) is only half that of replenisher(1) applied in examples 2 to 4.

It has been demonstrated that the application of a replenisher solution to the emulsion surface of color photographic paper at the same rate as it would be added to the developer Solution in a normal replenished process can accelerate the overall development. The application of replenisher is followed by development in a tank of standard developer solution as in the standard process except that a reduced development time is used. The method allows a 30 second process to give the same sensitometric result as the normal 45 second process. The replenisher applied is carried into the developer tank as it would be in a normally replenished process and thus the overall usage rate is the same.

It is envisaged that different chemical components of a replenisher can be applied to the surface of the material whilst it is immersed in the processing solution. These chemical components are usually supplied in the form of concentrates which are diluted with water to make the replenisher or added directly to the tank with a separate water addition. Since these concentrates are many times more concentrated than the working tank solution the initial rate of processing after the application of these to the material surface will be very high.

Although the present invention has been described with reference to the replenishment of photographic processing apparatus and solutions used therein, it will be appreciated that the present invention is not limited to such application.

The invention has been described in detail with particular reference to certain preferred embodiments thereof, but it will be understood that variations and modifications can be effected within the spirit and scope of the invention.

PARTS LIST

1. Material
2. Crossover between tanks
3. developer tank
4. supply pipe
5. casing
6. applicator
7. bleach-fix tank
8. stabilizer tank
9. tray
10. guide rollers
12. pipe
13. pipe
14. applicator
15. drum

What is claimed is:

1. A processing apparatus for processing a material having an emulsion surface and a non-emulsion surface, the apparatus comprising at least one processing stage having a processing solution which is used to process the material, characterized in that the apparatus further includes replenishment means positioned to supply replenisher directly to the emulsion side of the material so as to accelerate processing of the material and maintain sensitometry of said process solution.

2. A processing apparatus as claimed in claim 1 wherein the replenishment means is positioned within the processing solution.

3. A processing apparatus as claimed in claim 1 wherein the replenishment means is positioned prior to entry of the material into the processing solution.

4. A. A processing apparatus as claimed in claim 1 wherein the replenishment means comprises a foam pad applicator.

5. A processing apparatus as claimed in claim 1 wherein the replenishment means comprises a rotating drum.

6. A processing apparatus as claimed in claim 1 wherein the replenishment means comprises an inclined plane having a series of openings through which the replenisher passes.

* * * * *